US005782156A

United States Patent [19]

Collins

[11] Patent Number: 5,782,156

[45] Date of Patent: Jul. 21, 1998

[54] FLEXIBLE DIE AND SUPPORTING CYLINDER

[75] Inventor: Robert W. Collins, Overland Park, Kans.

[73] Assignee: Winkler & Dunnebier, Germany

[21] Appl. No.: 764,644

[22] Filed: Dec. 11, 1996

Related U.S. Application Data

[63] Continuation of Ser. No. 227,263, Apr. 13, 1994, abandoned.

[51] Int. Cl.[6] ..... B26D 7/26; B26D 1/62

[52] U.S. Cl. ..... 83/331; 83/100; 83/663; 83/698.42; 101/415.1

[58] Field of Search ..... 83/100, 331, 343, 83/346, 347, 663, 669, 670, 698.41, 698.42, 698.51, 698.61; 101/378, 415.1

[56] References Cited

U.S. PATENT DOCUMENTS

| | | | |
|---|---|---|---|
| 3,151,554 | 10/1964 | Townsend | 101/415.1 |
| 3,406,629 | 10/1968 | Hoexter | 101/415.1 |
| 3,578,761 | 5/1971 | Sarka | 83/698.42 X |
| 3,885,486 | 5/1975 | Kirkpatrick et al. | 83/698.42 X |
| 4,006,686 | 2/1977 | Ackerman | 101/415.1 |
| 4,187,752 | 2/1980 | Chesnut | 83/698.42 X |
| 4,191,076 | 3/1980 | Bollmer et al. | 83/698.42 X |
| 4,434,690 | 3/1984 | Mauer | 83/698.41 X |
| 4,823,659 | 4/1989 | Falasconi | 83/698.41 X |
| 4,934,231 | 6/1990 | Chesnut et al. | 83/698.42 X |
| 5,230,271 | 7/1993 | Hardistry et al. | 83/698.42 X |
| 5,253,561 | 10/1993 | Wynn | 83/698.41 X |
| 5,555,786 | 9/1996 | Fuller | 83/346 X |
| 5,570,620 | 11/1996 | Okonski et al. | 83/346 X |

FOREIGN PATENT DOCUMENTS

| | | | |
|---|---|---|---|
| 743783 | 10/1966 | Canada | 83/698.42 |
| 3544358 | 6/1987 | Germany | 83/698.42 |

*Primary Examiner*—Rinaldi I. Rada
*Assistant Examiner*—Clark F. Dexter
*Attorney, Agent, or Firm*—Kokjer, Kircher, Bowman & Johnson

[57] ABSTRACT

An improved flexible die and cylinder for mounting such die. The flexible die consists of a substantially planar, flexible, sheet of metal which has been etched to form a cutting edge. The ends of the die include a plurality of spaced holes for mounting the die to the cylinder. A pair of depressions in the exterior of the cylinder mount lock bars. The lock bars include a plurality of pins which engage the holes in the die. The cylinder includes a support segment and a transport segment. Air passages in the cylinder open onto an angularly extending selector groove at each end of the cylinder. A selector collar is mounted at each end of the cylinder and includes an air passage therethrough which will mate at one end with the selector groove, and at the other end with one of a series of discrete air channels extending longitudinally through the support segment. These channels in turn communicate with associated rows of the apertures. The angular orientation of the collar therefore determines the placement of the reduced or increased air pressure upon the support segment. Generally similar air channels extend through the transport segment. A selected one of these air channels may be connected to an air supply by a suction conduit. The conduit includes a biased sliding section such that the cylinder may be moved axially upon the shaft while maintaining the suction conduit in operative position.

14 Claims, 5 Drawing Sheets

FLEXIBLE DIE AND SUPPORTING CYLINDER

This is a continuation of application Ser. No. 08/227,263, filed Apr. 13, 1994, now abandoned.

BACKGROUND OF THE INVENTION

1. Field of the Invention

The present invention relates in general to cutting rollers for removing sections of webs and blanks. In particular, the present invention relates to an improved flexible die and supporting cylinder, especially useful for forming envelope blanks and the like.

2. Description of the Related Art

In the formation of blanks for envelopes, brochures, etc., it is often desired to remove a portion or "chip" from the blank for various purposes, such as to form an address window in an envelope. One well-known method for cutting the portion of the blank (or the blank itself) is to form a knife edge punch to be mounted upon one of the cylinders within the blank-forming machine. The punch will press against an anvil, with the blank therebetween, such that the chip is cut from the blank.

While such punches are sturdy and long-lasting, they are expensive. In particular, it is difficult to form a knife edge in a closed shape to form a chip, even more difficult to form the knife edge so that it will mount upon and about a cylinder and still provide the desired shape, and yet more difficult to maintain the edges of the punch radial to the cylinder to obtain a proper cut.

To overcome these difficulties, it has been known to employ flexible dies for such applications. Flexible dies are relatively thin sections of metal which may readily be wrapped over a section of a cylinder. The exterior face of the flexible die is etched to provide the cutting edge in the desired shape. Since etching is employed to create the cutting edge, flexible dies are much less expensive than standard punches. There are drawbacks to flexible dies, however.

First, the cutting edges of flexible dies wear out faster than standard punches. If this were the only consideration, the cost difference would still make flexible dies preferable for many applications. However, a second disadvantage has been mechanical failure of the prior art flexible dies, causing the flexible die to separate from the supporting cylinder. This mechanical failure ruins the flexible die, prematurely shortening its useful life.

The mechanical failure of prior art flexible dies typically takes place at the edges mounted to the cylinder. Such flexible dies have sharply angled "S" curves at these edges, which fit into a longitudinal depression in the cylinder. A mounting bar is then placed over a portion of these edges to secure the flexible die to the cylinder. The cyclic stresses experienced during use cause these sharply angled edges to fail at an undesirable rate.

The cylinder upon which the flexible die is mounted also presents problems. Specifically, such cylinders include an array of apertures about their periphery which is connected to suction during cutting, and then to high pressure to remove the chip. Since only a very few of the apertures (those within the confines of the cutting edge) are actually employed in this action, all remaining apertures (those not covered by the flexible die) must be covered with adhesive tape. This process is tedious and difficult. Additionally, the tape has a tendency to cause the blanks to misfeed.

SUMMARY OF THE INVENTION

An object of the present invention is to provide a flexible die having improved lifespan.

Another object of the present invention is a flexible die having reduced fabrication costs.

Another object of the present invention is to provide an improved mounting arrangement for a flexible die, such that the die may be easily, yet reliably, mounted.

Yet another object of the present invention is to provide an improved cylinder for mounting a flexible die.

Yet another object of the present invention is to provide a cutting cylinder for a flexible die which permits selective application of reduced or increased air pressure about the circumference of the cylinder.

A further object of the present invention is to provide such an improved cylinder in which the circumferential location of the reduced or increased air pressure is quickly and easily varied.

These and other objects are achieved by an improved flexible die and cylinder for mounting such die. The flexible die consists of a substantially planar, flexible, sheet of metal which has been etched to form a cutting edge. The longitudinal ends of the generally rectangular metallic die include a plurality of spaced holes for mounting the die to the cylinder. A pair of depressions in the exterior of the cylinder will mount lock bars. The lock bars include a plurality of pins extending upward which engage the holes in the die to secure it to the cylinder.

The cylinder includes a pair of cylinder halves which mate together to form a substantially tubular configuration to thus be mounted upon a rotary shaft of a prior art blank forming machine. As is known in the art, such a shaft will include a plurality of air holes to provide reduced and increased air pressure during operation, and also mounts a collar which provides a secondary source of reduced air pressure. The cylinder halves mount about this shaft and in turn mount (or include) a support segment and a transport segment. Each of the segments is in the form of a section of a cylinder, having an angular extent less than 180°. The segments will be mounted to the exterior of the cylinder halves such that their edges are spaced from each other. These spaces define the depressions within which are mounted locking bars.

The cylinder halves include a plurality of air passages which mate at their radially interior end with an associated air passage in the shaft. These air passages extend longitudinally of the cylinder halves and open onto an angularly extending selector groove. A selector collar is mounted at each end of the cylinder and includes an air passage therethrough which will mate at one end with the selector groove, and at the other end with one of a series of discrete air channels extending longitudinally through the support segment. These channels in turn communicate with associated rows of apertures on the surface of the cylinder. The angular orientation of the collar therefore determines the placement of the reduced or increased air pressure upon the support segment. Generally similar air channels extend through the transport segment. A selected one of these air channels may be connected to the auxiliary air supply of the prior art shaft by a suction conduit. The suction conduit includes a biased sliding section such that the entire cylinder may be moved axially upon the shaft to a certain extent while maintaining the suction conduit in operative position.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
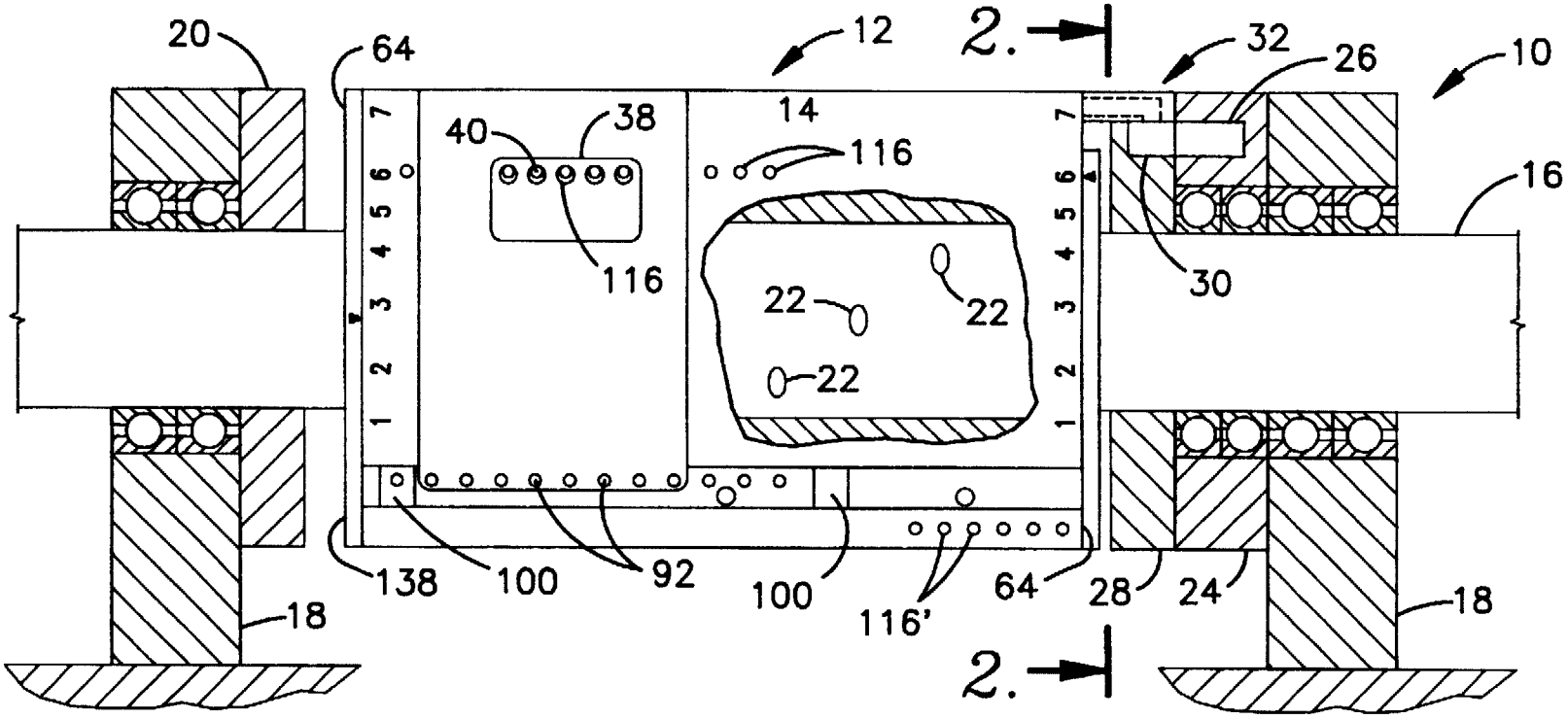
FIG. 1 is a front view in partial cross-section of a prior art shaft, mounting a cylinder according to the present invention.

With reference to FIG. 1, a prior art shaft assembly, typically employed in a blank forming apparatus, is generally designated by reference numeral 10. The prior art shaft assembly 10 mounts a cylinder according to the present invention, generally designated by reference numeral 12. The cylinder 12 in turn mounts a flexible die according to the present invention, generally designated by reference numeral 14.

The prior art shaft assembly 10 typically includes a rotary shaft 16 mounted for rotation about its longitudinal axis by a pair of spaced journal blocks 18. The journal blocks are rigidly connected to the remainder of the apparatus, which, as noted above, is typically a blank forming apparatus, such as for envelope blanks. The journal blocks 18 will include appropriate bearings to permit smooth rotation of the shaft 16, and there will be provided appropriate drive and timing equipment (not shown) to cause rotation of the shaft 16 at the desired rate. To provide an accurate indication of the angular position of the shaft and cylinder mounted thereon, there may be provided various timing collars 20, as is known in the art.

The shaft 16 includes a plurality of air pressure openings 22 spaced circumferentially and/or longitudinally upon its exterior. These air pressure openings are connected, selectively, to a source (not shown) of reduced air pressure (suction) and increased air pressure (blower) depending upon the angular position of the shaft, as is known in the art. Additionally, one or both of the journal blocks 18 may mount a fixed air supply collar 24, within which the shaft 16 rotates.

Figure 2:
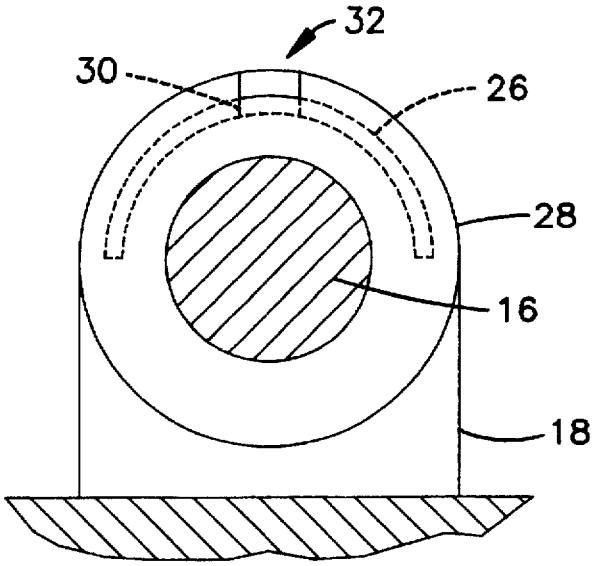
FIG. 2 is a cross-sectional view along line 2—2 of FIG. 1.

The air supply collar 24 will include a semi-circular channel 26 extending about a predetermined angular extent (as shown in FIG. 2). Fixed to the shaft 16 in close relationship with the fixed air supply collar 24 is a rotating air supply collar 28. The air supply collar 28 includes a notch 30 having a limited angular extent. At one longitudinal end the notch 30 may communicate with the channel 26, and at the other end the notch 30 is open radially outward. As such, the notch 30 will be in communication with the channel 26 and thus with the source of reduced air pressure (suction) connected to this channel. In prior art devices, this notch 30 will typically mount a vacuum bar used to secure the leading edge of the blank to the prior art cylinder. In the present invention, the notch 30 is preferably used to mount a suction conduit, generally designated by reference numeral 32, which communicates with the cylinder 12 to perform a function similar to that in the prior art.

Figure 3:
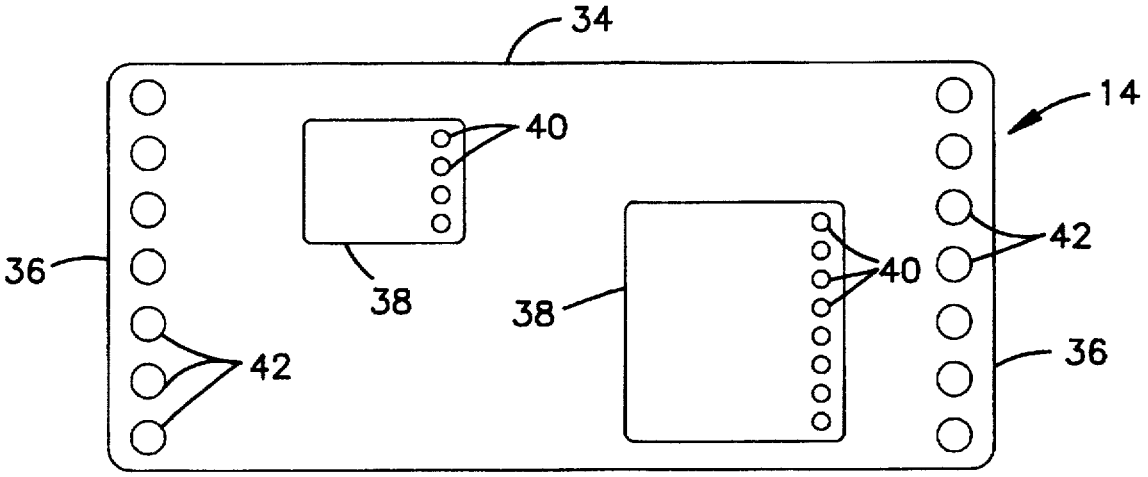
FIG. 3 is a plan view of a flexible die according to the present invention.

With reference to FIG. 3, the flexible die 14 according to the present invention is shown. The die 14 is generally similar to prior art flexible dies, in that it consists of a generally rectangular, thin sheet of flexible metal. This rectangular sheet includes lateral edges 34 and longitudinal ends 36. As is shown in FIG. 1, when mounted upon the cylinder, the longitudinal ends 36 will extend parallel to the longitudinal axis of the shaft 16, while the lateral edges 34 extend in an arc about the cylinder 12.

As is known in the art, the die 14 will include one or more raised patterns 38 formed by etching, with these raised patterns being quite sharp so as to cut through the blank. In its typical application, the patterns 38 will each define an enclosed space, such as for example to act as a punch to cut out an address window in an envelope blank. As is known in the art, within each of these patterns there will be provided a series of apertures 40 to permit suction and blowing to be transferred to the blank, and in particular the chip cut from the blank. As is known, this will permit suction to be applied to retain the blank, and then the chip formed by the blank, and high pressure to thereafter blow the chip from the die in a stripping step.

The differences between the die 14 and prior art dies is in the mounting means. The die 14 includes a plurality of mounting holes 42 spaced along each of the longitudinal ends 36. This comprises the entirety of the mounting means for the die 14, and there are no sharp bends as in the prior art. The holes 42 interact with a mounting means upon the cylinder 12 to maintain the die upon the cylinder in the proper position. As there are no sharp bends, this reduces the stress upon the die, increasing its useful life. Additionally, it is not necessary to perform the steps to produce the bends in the die 14, which thus reduces its production cost.

Figure 4:
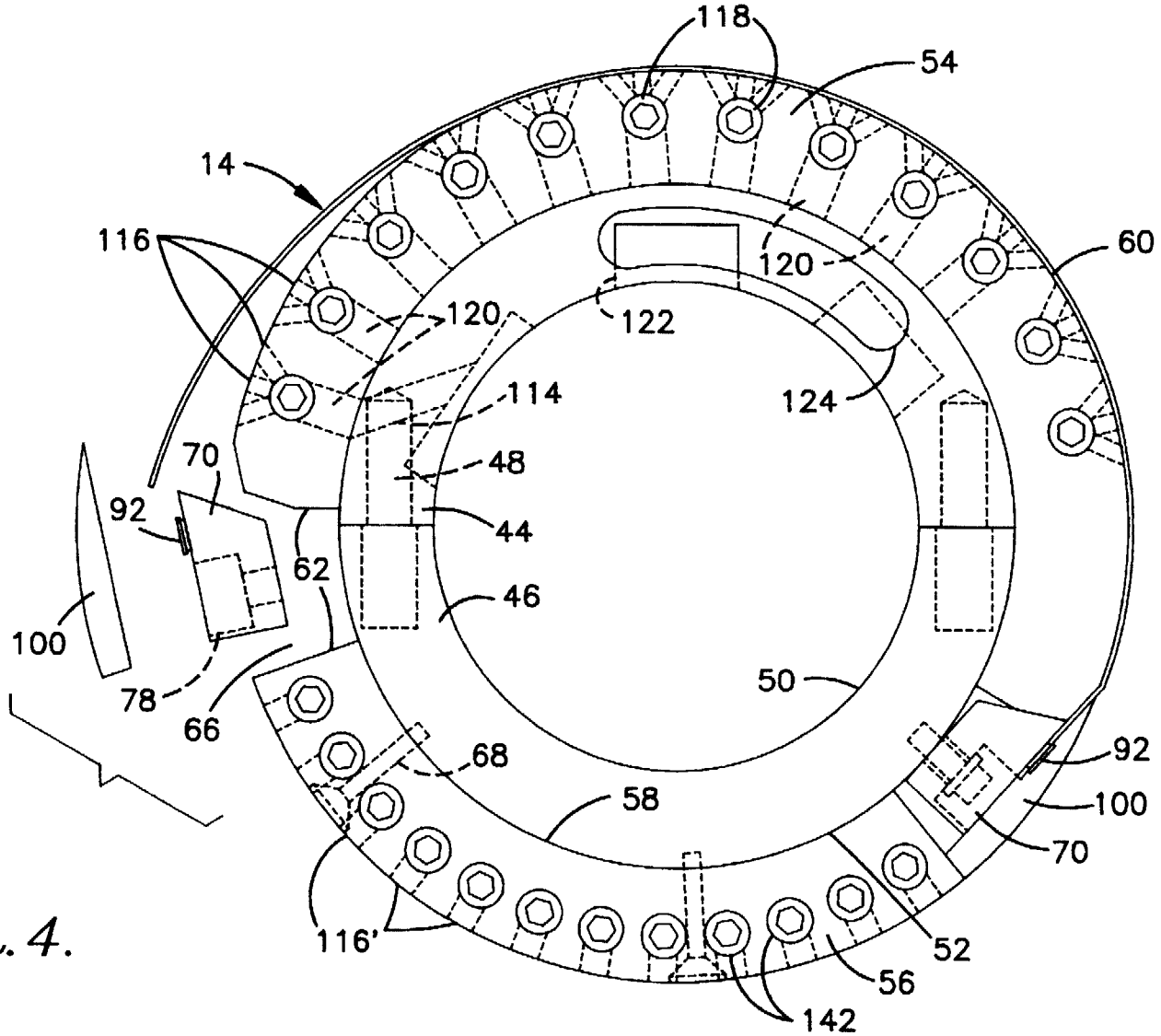
FIG. 4 is a partially exploded end view of a cylinder according to the present invention with a flexible die according to the present invention mounted thereon.

The cylinder 12 according to the present invention will now be described with reference to FIGS. 1 and 4. As is best shown in FIG. 4, the cylinder 12 includes first and second cylinder halves 44 and 46. Each of the cylinder halves is in the form of a half-tube, such that the cylinder halves may be placed together in mating relationship to form a tubular configuration which fits upon the shaft 16. Appropriate threaded passages 48 may extend perpendicular to the parting line between the cylinder halves 44 and 46 such that the cylinder halves may be secured in their mating relationship by appropriate bolts (not shown). The cylinder halves may be secured to the shaft 16 by their central opening 50 having a very tight fit upon the shaft. Alternatively, appropriate radial passages may be provided in one or both of the cylinder halves to secure the cylinder halves to the shaft by appropriate bolts or set screws.

As may be envisioned, when the cylinder halves 44 and 46 are in their assembled relationship, they form a substantially continuous cylinder exterior 52, having a cylindrical configuration. Mounted upon this cylindrical exterior are a support segment 54 and a transport segment 56.

Each of the segments 54 and 56 take the form of an angular section of a tube, such that the interior faces of the segments will closely conform to the cylindrical exterior 52 of the cylinder halves, while each segment has an exterior face forming a section of a cylinder. The segments 54 and 56 together will have an angular or circumferential extent less than 360°, preferably with each segment having an angular extent less than 180°.

Each of the segments will therefore have a cylindrical interior face 58, a cylindrical exterior face 60, a pair of lateral edges 62 (extending parallel to the longitudinal axis of shaft 16), and a pair of longitudinal ends 64 (FIG. 1) in a plane normal to the longitudinal axis of the shaft.

This arrangement permits the segments 54 and 56 to be mounted upon the cylinder halves with their lateral edges 62 in spaced arrangement to define a pair of bar grooves 66. The support segments 54 and 56 may be secured to the cylinder halves by providing passages therethrough in alignment with threaded holes in the associated cylinder halves 44 and 46. This will permit bolts 68 to pass through the segments 54 and 56 to secure them in position. It is noted that the support segments may extend over the parting line between the cylinder halves 44 and 46 if so desired, although this is not required.

Figure 5:
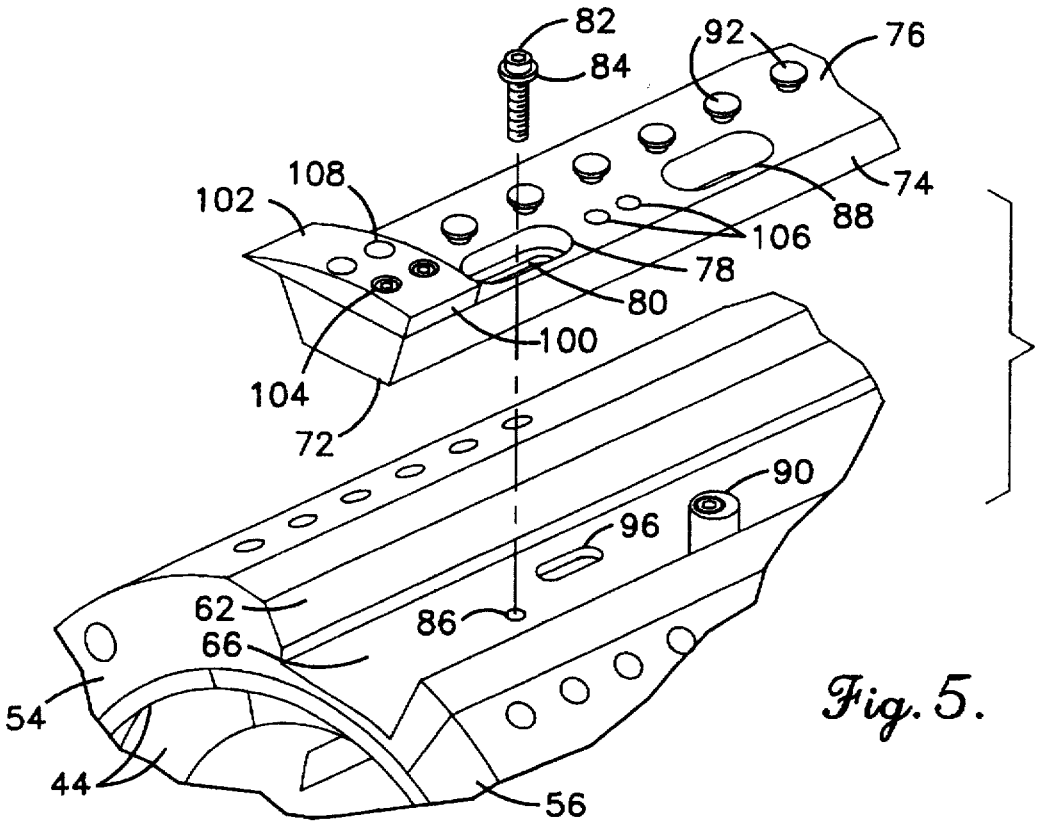
FIG. 5 is a detailed perspective view of a mounting bar according to the present invention.

Additionally, it is noted that the segments 54 and/or 56 need not be formed as separate members from the associated cylinder halves, as shown in figures. For example, the support segment 54 and the cylinder half 44 may be a monolithic unit. Where this is the case, it is preferred that the support segment 54 (or transport segment 56) be fully contained within the angular extent of the associated cylinder half. For reasons discussed more fully below, it is preferred that at least the transport segment 56 be formed separate from the second cylinder half 46. Additionally, the bar grooves 66 need not be formed at the intersection of the support and transport segments. As shown in FIG. 5, the grooves 66 may simply be formed as depressions in the exterior of the support and/or transport segment(s).

Each of the bar grooves 66 serves to mount an associated locking or mounting bar 70. Each locking bar 70 is elongated, with a length less than that of the support segment 54. Locking bars 70 each include a bottom face 72 which may include an appropriate curvature to match that of the cylinder half exterior 52 (or the cylinder half/support segment combination). Alternatively, the cylinder half (or cylinder half/support segment combination) may be flattened at the position of the bar grooves 66 to provide a substantially planar bottom for the groove. In such a case, the bottom face 72 of the locking bar may of course be planar.

Each locking bar also includes a pair of lateral faces 74, which may similarly have a mating angle or contour with the associated lateral edges 62 of the segments 54 and 56, however it is preferred that the angular extent between each pair of lateral faces 74 be less than the angular extent between the associated pair of edges 62 (in other words, the locking bar is thinner than the associated groove). This will permit the locking bar 70 to move in the angular or circumferential direction within the groove for a purpose more fully described below. Finally, each locking bar 70 will include an outer face 76. The outer face 76 is preferably planar or with a slight cylindrical curvature, but is also preferably recessed below the exterior face 60 of the support segment 54, for reasons discussed more fully below.

As noted above, the locking bar 70 preferably may be mounted for angular movement within the groove 66, and is also preferably mounted for longitudinal adjustment.

To permit this adjustment, the locking bar 70 will include, as a means for securing the locking bar to the cylinder, at least one, and preferably two, bolt depressions 78 (FIGS. 4 and 5) extending into the outer face 76. The bolt depression 78 will be elongated in the longitudinal direction, have a depth less than that of the locking bar 70, and have a width (in the angular or circumferential direction) greater than that of the head or washer 84 of a bolt 82 associated with the depression 78. Located centrally within the bolt depression 78 is a bolt slot 80. Bolt slot 80, like the depression 78, is elongated in the longitudinal direction. Additionally, the bolt slot 80 has a width greater than the shaft size of the bolt 82.

Located within the groove 66 is a threaded opening 86 adapted to receive the shaft of bolt 82. As may be envisioned, when the locking bar 70 is located within the groove 66 and the bolt 82 has been loosely engaged with the opening 86, the locking bar 70 may move longitudinally within the groove by virtue of the elongated nature of the slot 80 and depression 78. Additionally, the width of the slot 80 allows the locking bar 70 to move in the angular or circumferential direction within the groove 66, with the washer 84 (or enlarged head) of the bolt maintaining engagement with the bottom of the bolt depression 78.

To assist in the angular or circumferential movement of the locking bar 70 within the groove 66, the locking bar 70 may be provided with at least one, and preferably two, cam slots 88. Each of the cam slots 88 extends through the locking bar 70 and is elongated in the longitudinal direction. Located within the groove 66 are a similar number of rotatably mounted cams 90. Each cylindrical cam 90 takes the form of a rigid cylinder or sleeve extending upward from the bottom of the groove 66, with the cylinder having a connecting bolt extending therethrough at a position offset from the cam cylinder's longitudinal axis. As such, rotation of the bolt will cause rotation of the cam cylinder, to provide a camming effect. When the locking bar 70 is located within the groove, the cam 90 will extend upward into the cam slot 88 with a close sliding fit. As such, rotation of the bolt and associated camming action of the cam 90 will cause the desired circumferential movement.

Extending upwardly from the outer face 76 of the locking bar 70 is a plurality of mounting pins 92. The mounting pins 92 are spaced uniformly in the longitudinal direction adjacent one edge of the locking bar, with the spacing corresponding to that of the mounting holes in the flexible die. Each of the mounting pins 92 includes a shaft and an enlarged head spaced from the outer face of the locking bar. The enlarged heads of the mounting pins are preferably flattened and have a diameter less than that of the mounting holes 42 within the flexible die 14.

As may be envisioned, the flexible die 14 may be wrapped about the support segment 54 and have the mounting holes 42 engaged with the shafts of appropriate ones of mounting pins 92. As a large number of the mounting pins are provided, the gross longitudinal position of the flexible die 14 upon the cylinder 12 is easily accomplished simply by choosing the appropriate set of pins. As may be envisioned, the mounting holes 42 may pass over the enlarged heads and then be placed in abutment with the shafts of the pins, such that the enlarged heads prevent removal of the flexible die from the cylinder.

At this point, fine longitudinal adjustment of the flexible die 14 is possible due to the longitudinal adjustment ability of the locking bar 70. The cams 90 are then employed to cause the circumferential movement described above to move the two locking bars 70 away from each other to thus place the flexible die 14 in tension, and thus securely retain it upon the cylinder 12. Once the flexible die has been properly positioned, the bolt 82 may be tightened to secure the locking bars in their desired position, thus securing the flexible die in its desired position also.

As is best shown in FIG. 4, since the mounting pins 92 must extend below the cylindrical exterior of the cylinder 12, the longitudinal ends of the flexible die will be flexed downward over the edges of the grooves 66. While this arrangement does produce some stress in the material of the flexible die, the stress is believed to be much less than that experienced in the prior art devices, and is believed to permit a greatly increased life expectancy for the die.

As the mounting pins are below the cylindrical periphery of the cylinder, it may be difficult to cause the mounting holes to pass over the mounting pins 92. In practice it has been found helpful to lift the locking bar 70 slightly out of the groove. To assist in this, the locking bar 70 may be provided with a spring pin 94 extending downward from its bottom face 72. The spring pin 94 may be received within a spring depression 96 located in the bottom of the groove 66, with the depression 96 having a depth greater than the length of the spring pin 94. A spring 98 may be mounted upon the spring pin 94, such that the spring 98 will exert a force between the groove 66 and the locking bar 70. By providing an appropriate spring force, the spring 98 may lift the locking bar 70 to an elevated position and assist in mounting the flexible die upon the locking bars. The spring 98 may of course be overcome by the tightening of the bolt 82, such that the locking bar 70 may obtain its locked and secured position.

In certain applications, the presence of the grooves 66 may be detrimental to the passage of the blank through the equipment. To reduce this possibility, there may be provided one or more guide lugs 100. The guide lugs may be mounted upon the outer face 76 of the locking bar 70, with each guide lug having an outer face 102 having a semi-cylindrical form to act as a continuation of the cylindrical exterior of the cylinder 12. Appropriate holes 104 may be provided through the lugs 100 such that bolts (FIG. 5) may be passed through the holes and engaged with threaded holes 106 in the outer face of the locking bar 70. To allow placement of the lugs 100 at a variety of positions, it is preferred that there be numerous threaded holes 106 along the length of each locking bar. Additionally, it may be desirable to provide depressions on the bottom of the lugs 100, or possibly holes 108 extending therethrough, such that the mounting pins will not interfere with the lugs 100. The lateral ends of the lugs 100 are preferably formed with a generally mating configuration with the sides of the grooves 66 to permit a mating abutment with one or more of the sides of the grooves to provide a more continuous cylindrical form.

As may be seen, the flexible die and cylinder mounting arrangement according to the present invention allows the use of a flexible die having an improved design providing increased longevity with reduced production costs. Additionally, the mounting arrangement provides for a wide variety of adjustment, both gross and fine, upon the cylinder. Further, the mounting arrangement is relatively simple in actual use to thus reduce labor costs.

The above arrangement for mounting a flexible die is just a first aspect of the present invention. This invention further envisions a cylinder arrangement which allows selective communication with a pneumatic source to reduce the need for tape upon the exterior of the cylinder, as was known in the prior art. This arrangement may of course be employed with flexible dies mounted using prior art techniques, just as the present mounting technique may be used with cylinders not having selective communication with the pneumatic source.

Figures 6, 7:
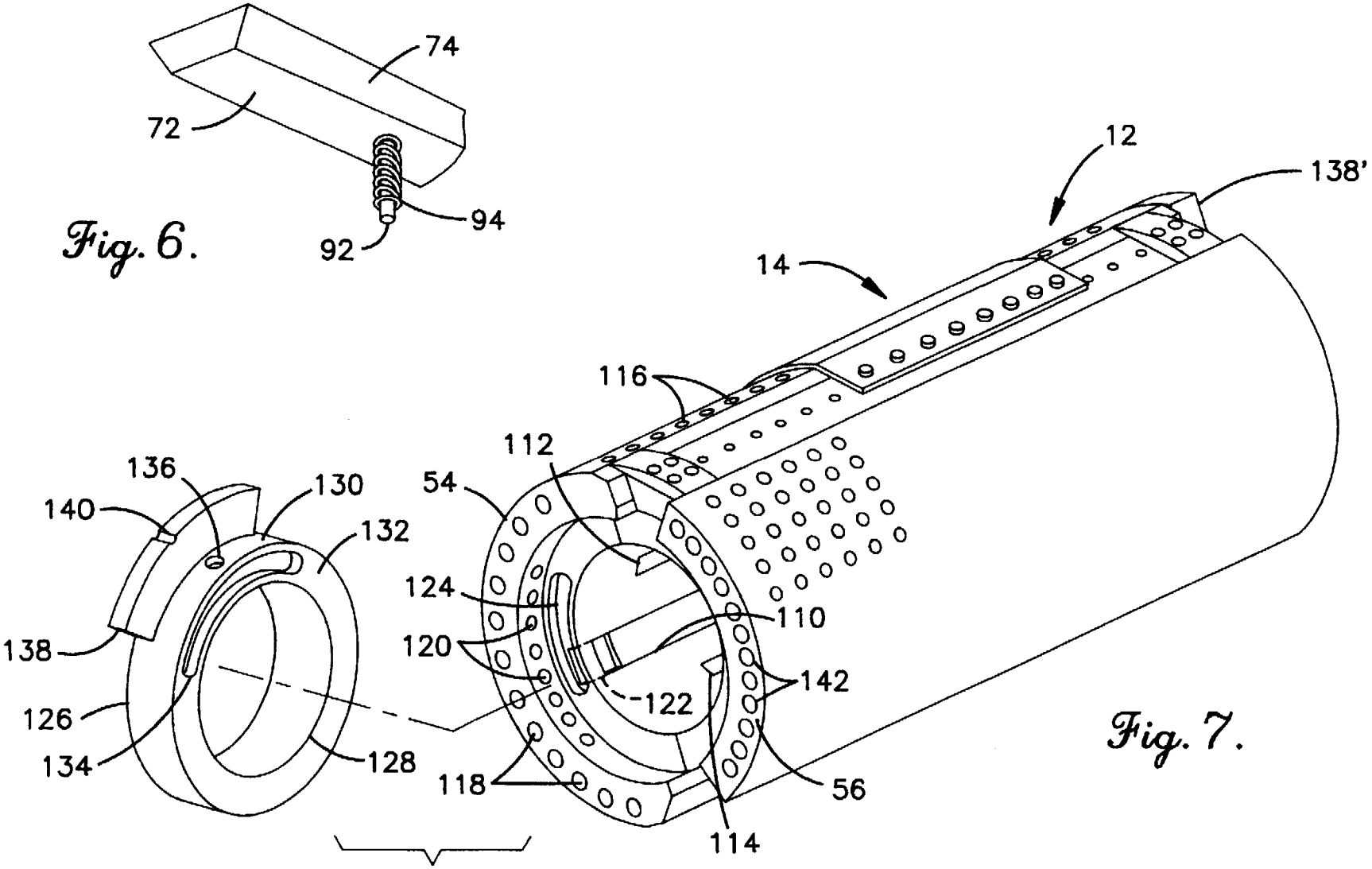
FIG. 6 is a reverse angle perspective view of the mounting bar of FIG. 5.
FIG. 7 is an exploded perspective view showing the cylinder air passage arrangement according to the present invention.

With reference to FIG. 7, the first cylinder half 44 may be seen to include at least one air inlet on its interior peripheral face. In the preferred embodiment, the cylinder half 44 will include first, second, and third air inlets 110, 112, and 114. Each of the air inlets is elongated in the longitudinal direction, has an angular width greater than the air pressure openings 22 in the shaft 16, and is located to be associated with one of the openings 22. As such, the cylinder 12 may be positioned longitudinally and angularly upon the shaft 16 while maintaining the inlets 110, 112, 114 in communication with the associated openings.

As is best seen in FIG. 7, the exterior face 60 of the support segment 54 includes an array of apertures 116, generally extending in rows in the longitudinal direction. According to the present invention, selected ones of these rows may be provided with communication to a pneumatic source, vacuum and/or pressure (not shown), as may be desired. The mechanism for providing this selection will now be described.

As is best shown in FIG. 4, the support segment 54 includes a plurality of angularly spaced longitudinally extending air channels 118. Each of the air channels 118 is in full communication with at least one, and preferably three, adjacent rows of the apertures 116. The longitudinal ends of the air channels 118, which open onto the longitudinal ends 64 of the segment 54, are blocked in an airtight manner as by a set screw or similar bolt 119. The longitudinal ends 64 of the support segment 54 are formed to extend longitudinally outwardly from the longitudinal end of the cylinder half 44. As such, a section of the interior face 58 of the support segment 54 is accessible at each longitudinal end of the cylinder. Within this accessible portion of the interior face 54, there are provided a plurality of selector holes 120 passing from the interior face 58 to an associated one of the air channels 118.

At each longitudinal end, there may be provided selector holes 120 to access all, or less than all, of the air channels 118. In practice, it has been found that providing selector holes 120 for a majority of the channels 118 at each end is preferred. Those channels 118 which are not accessed at one longitudinal end of the cylinder should, of course, be accessed at the other end to provide access to all channels 118.

The first air inlet 110 communicates with a first tunnel or passage 122 extending longitudinally within the first cylinder half 44 and opening on a first longitudinal end of the cylinder half. Where the first passage 122 opens onto the end of the cylinder half, there is a formed and elongated semi-circular selector groove 124. As such, the first air inlet 110 freely communicates with the selector groove 124 via the passage 122.

Next there is means for selective communication between the groove 124 and the various selector holes 120, to thus effect the selective use of apertures 116. This means takes the form of a selector collar 126. The selector collar 126 has the general form of an annulus with a circular inner periphery 128, preferably having a inner diameter such that it may slide freely upon shaft 16. While it is important for the collar 126 to be capable of angular movement with respect to the cylinder halves 44 and 46, there must be a mechanism to allow the collar to be selectively fixed with respect to the cylinder halves during operation.

One method is to provide collar 126 with a circular outer periphery 130 sized to be tightly received within the interior faces 58 of the support segment 54 and transport segment 56. While this outer periphery is closely received, it is noted that the support and/or transport segment may be loosened from the associated cylinder half such that the selector collar 126 may be manually rotated with respect to the support segment, and thereafter fixed in position.

As an alternative, the collar may have an outer diameter which allows free rotation with respect to the cylinder, but there may be provided a threaded hole (not shown) extending radially through a section of the collar (typically through element 138 introduced below) . A set screw may then pass through this hole and be tightened into position against the exterior of shaft 16.

Collar 126 additionally includes an interior face 132 which is substantially planar and adapted to closely fit against the longitudinal end of the cylinder half 44 (and cylinder half 46). As with the cylinder half 44, the selector collar 126 includes a collar groove 134 extending into the interior face 132, with the groove being elongated angularly, and further located such that it may freely communicate with the selector groove 124 throughout the desired angular extent of the adjustment of the collar with respect to the support segment.

A collar hole 136 extends radially between the collar groove 134 and the outer periphery 130 of the collar 126. The collar hole has a diameter generally equal to that of a selector hole 120. As may be envisioned, alignment of the collar hole 136 with one of the selector holes 120 will provide selective pneumatic communication with the apertures 116 associated with that selector hole. In particular, pneumatic communication will pass from the first air inlet 110 through the first passage 122 and into the selector groove 124. Communication will then pass to the collar groove 134 and collar hole 136. Communication then further passes to the aligned selector hole 120, its associated air channel 118, and its associated apertures 116. As such, angular rotation of the collar 126 with respect to the support segment 54 will bring the collar hole 136 into alignment with a selected one of the holes 120, thus allowing the user to select which row or sets of rows of apertures 116 are provided with pneumatic communication. All other apertures 116 are thus cut off from pneumatic communication and need not be taped for use.

It is noted that the entire row or set of rows is placed in pneumatic communication. Therefore, it is still necessary to apply tape to cover that portion of the selected row which extends beyond the lateral edges of the flexible die. However, this still greatly reduces the amount of taping required, reducing set-up time and labor costs, in addition to reducing the chance of fouling during operation.

While this arrangement provides pneumatic communication for the limited number of apertures necessary to retain and expel the chip within the pattern 38 on the flexible die, there are situations where multiple patterns 38 are employed. As such, it is preferred that the second longitudinal end of the cylinder half 44 and support segment 54 be provided with a second selector collar, second series of selector holes 120, etc., all in communication with the second air inlet 112. This permits two separate rows (or set of rows) to be activated at the same time. As noted above, it is preferred that there be some overlap in the selector holes 120 at each longitudinal end. This will allow for a situation where the patterns 38 on the flexible die are closely spaced in the angular direction, and thus closely adjacent rows must be activated.

To assist in determining which of the rows or set of rows of apertures 116 have been selected by the collar 126, the collar is preferably provided with a radially extending lug 138, with the radial extent of the lug being equal to or less than the thickness of the support segment 54, such that the lug does not interfere with the cylindrical periphery of the cylinder. The lug may include an appropriate pointer 140, and the outer periphery of the support segment 54 may be provided with appropriate indicia, such as numbers, superimposed on each of the air channels 118. This will permit the pointer 140 to be aligned with the desired air channel quickly and easily.

In many cases it is desirable to have one row of apertures 116, and in particular the first set of rows in the direction of rotation, constantly connected with the pneumatic source. Where this is desired, the associated air channel 118 may be provided with a radially extending hole passing through the first cylinder half 44 and in constant communication with the third air inlet 114. In this manner, the first set of apertures 116 may be constantly in communication.

While the apertures 116 and the support segment 54 are sufficient for providing the suction and pressure necessary for the chip removed by the die 14, it is often desirable for the cylinder 12 to include a further suction arrangement to engage with the leading edge of the blank. This leading edge will typically be located at the transport segment 56 during rotation of the cylinder. As such, it is desirable to provide pneumatic communication additionally for the transport segment 56.

Towards this end, the transport segment 56 may be provided with a plurality of angularly spaced, longitudinally extending suction channels 142 (FIGS. 4 and 8) similar to the air channels 118. These suction channels are preferably closed at one end, yet open at the other for communication directly at the longitudinal face of the transport segment 56. As with the air channels, the suction channels will communicate with associated rows of an array of apertures 116' on the exterior of the transport segment.

The suction provided to the desired one of the channels 142 may come from the air pressure openings 22 located within the shaft 16, by providing a passage arrangement similar to that used with the third air inlet 114. However, it is preferred to employ the rotating air supply collar 28. As such, there is provided the suction conduit 32 which may be placed within the notch 30 and provide pneumatic communication with one of the open ends of the suction channels 142.

Figure 8:
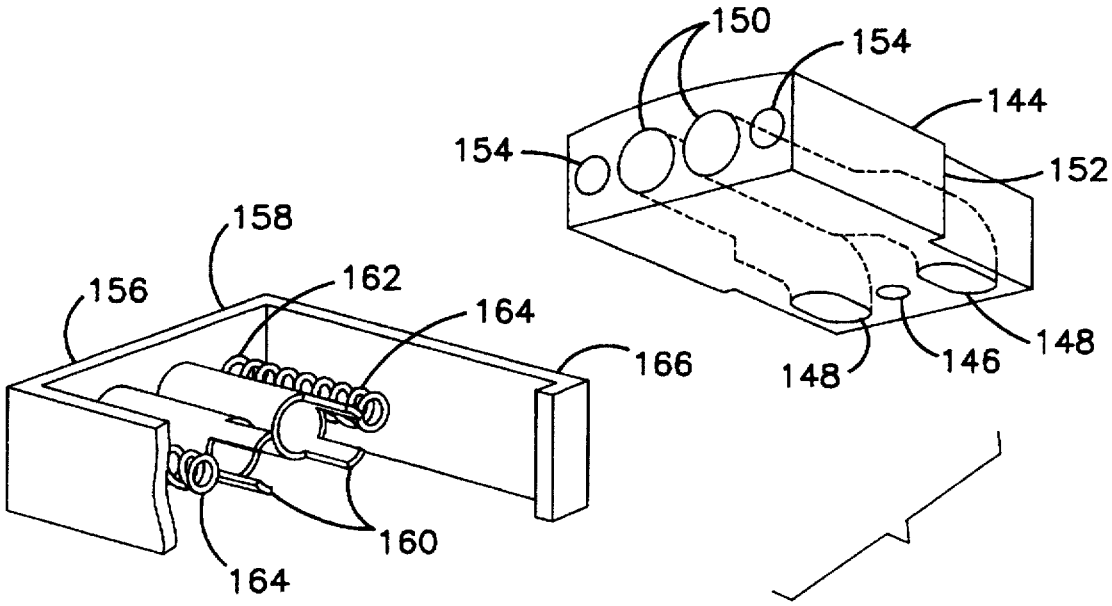
FIG. 8 is a perspective view showing a suction conduit according to the present invention.

With reference to FIG. 8, there is shown the suction conduit 32 in exploded condition. As may be seen, the suction conduit 32 includes a base section 144 having a generally rectangular configuration, and a through hole 146 adapted for the passage of a bolt to secure the conduit 32 to the collar 28. The base section 144 includes at its lower face a pair of suction openings 148 which may open onto the notch 30 and thus communicate with the source of suction (not shown) connected to the fixed air supply collar 24.

Each of the suction openings 148 leads into a cylindrical suction duct 150 which opens onto a front face of the base unit. The side edges of the base unit include outwardly extending shoulders 152, and the front face of the base unit includes a pair of depressions 154, both for a purpose described more fully below.

The conduit 32 additionally includes a slide section 156 which cooperates with the base section 144. Slide section 156 includes a substantially planar front wall 158 which is adapted to abut against the longitudinal end of the transport segment 56. The front wall 158 includes a pair of suction tubes 160 extending therethrough and rearward therefrom. The suction tubes 160 are sized and located such that they may be closely received within the suction ducts 150 opening in the front face of the base unit 144. As such, the tubes 160 may be placed in pneumatic communication with the suction openings 148 and thus the collar 28.

The front wall 158 of the slide section additionally includes a pair of rearward opening depressions 162. These depressions are opposed to the depressions 154 when the tubes 160 are received within the ducts 150. Biasing springs 164 will be interposed between each set of depressions, such that the slide section 156 is biased outward away from the base section 144. To maintain these two sections together, the slide section 156 includes a pair (only one shown) of hook members 166 extending rearward from each side. These hook members will engage against the shoulders 152 against the force of the springs 164, to thus maintain the suction tubes within the ducts 150. However, the slide section 156 may be moved towards the base section 144 against the force of the springs. When this occurs, the tubes will slide inward within the ducts 150, while the hook members 166 simply move rearward with respect to the shoulders 152.

The suction conduit 32 may thus be secured to the rotating air supply collar 28, and the rotating air supply collar angularly moved with respect to the shaft 16 to an angular position such that the suction tubes 160 are aligned with, and open onto, the desired ones of the suction channels 142 in the transport segment 56. In this manner, the suction channels and associated apertures 116' in the transport segment 56 will be in pneumatic communication. As noted above, the collar 28 communicates with the channel 26 in the fixed collar 24, such that there is pneumatic communication through the conduit 32 only during a portion of the rotation of the shaft 16. As is known in the art, this portion of the rotation will correspond to that necessary to maintain the leading edge of the blank in position.

As may be envisioned, the ability of the slide section 156 to move in the longitudinal direction of shaft 16 with respect to the base section 144 will allow the cylinder 12 to be moved longitudinally upon the shaft, as for adjustment, without the need to provide a different conduit having a different longitudinal length, and thus reduces labor and inventory expenses.

It should be noted that while two ducts and tubes have been shown for the conduit, a lesser or greater number could be employed. This is dependent upon the number of rows of apertures 116' it is desired to activate. Furthermore, while the use of a conduit 32 and transport segment 56 has been shown in the preferred embodiment, it is possible to remove the transport segment 56 from the associated second cylinder half 46 and employ a prior art vacuum bar connected to the notch in the collar 28.

Where this is the case, it is noted that the longitudinal ends of the transport segment will not be available to help maintain the selector collar in its angular position. As such, it may be preferred to form the cylinder halves 44 and 46 with a shoulder, such that the cylinder halves themselves receive the outer periphery of the selector collar 126. This alternate arrangement having a shoulder is shown in FIG. 5, in contrast to the original arrangement shown in FIG. 4. It will of course be necessary to run selector holes 120 through the shoulders in the cylinder halves for communication with the selector holes 120 in the support segment 54.

Additionally, it is noted that the lug 138 of the selector collars are intended to extend radially outward near the outer periphery of the segments 54 and 56. However, this would obviously interfere with access to the suction channels 142 opening onto the longitudinal face of the transport segment 56. As such, it is desirable to form the lugs 138 at a position, and with an angular extent, such that during their full range of movement there will be no interference of the lug with the channels 142.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matters herein set forth or shown in the accompanying drawings is to be interpreted as illustrative, and not in a limiting sense.

What is claimed is:

1. A blank forming apparatus comprising, a cylinder, a pair of mounting bars, and a flexible die, said die including a plurality of apertures and said cylinder including a support segment upon which the die rests, said support segment being bounded in the circumferential direction by a pair of longitudinally extending grooves, with one of the mounting bars mounted within each said groove, said apparatus further comprising a plurality of mounting pins extending outwardly in a radial direction from each bar, said plurality of pins being spaced from one another in the longitudinal direction of the respective bar and in the longitudinal direction of said cylinder, each pin having a shaft which extends through a corresponding aperture in said die and a head for passage through said corresponding aperture, said shaft having a first end connected to said bar, and said head positioned on said shaft and spaced from said first end.

2. The blank forming apparatus of claim 1, further including means for securing said bar to said cylinder within a range of positions within said groove, said range of positions including a longitudinal range and an angular range, with respect to said cylinder.

3. The blank forming apparatus of claim 2, wherein each groove includes at least one rotatably mounted cylindrical cam extending radially therefrom, and each bar includes a slot, elongated in the longitudinal direction, which receives said cylindrical cam, whereby rotation of said cylindrical cam causes angular movement of said bar with respect to said cylinder as said cylindrical cam engages said slot.

4. The blank forming apparatus of claim 3, wherein said cylindrical cam comprises a sleeve having a longitudinal axis and a bolt extending through said sleeve along an axis offset from said longitudinal axis of said sleeve, said bolt rotatable connected to said cylinder but fixed with respect to said sleeve, whereby rotation of said bolt causes rotation of said sleeve.

5. The blank forming apparatus of claim 2, wherein said means for securing comprises at least one elongate slot located in said bar, and a bolt extending through said slot and engaging said support segment.

6. The blank forming apparatus of claim 1, further including means for biasing said bar radially outward from said cylinder.

7. The blank forming apparatus of claim 6, wherein said means for biasing includes at least one spring extending outwardly from a bottom surface of said bar for positioning against said support segment.

8. A blank forming apparatus comprising a flexible die, a mounting bar and a cylinder, said flexible die having a plurality of apertures therein, said die positioned on an outer surface of a support segment of said cylinder, said bar attached to said cylinder within a groove in said cylinder, said apparatus further including a plurality of pins extending radially outwardly from an outer surface of said bar and through said apertures in said die, and further including means for adjustably positioning said bar on said cylinder in said groove.

9. The blank forming apparatus of claim 8, wherein at least one elongate slot is located in said bar and a bolt extends through said slot and engages said cylinder.

10. The blank forming apparatus of claim 8, further including means for biasing said bar upwardly out of said groove.

11. The blank forming apparatus of claim 10, wherein said means for biasing comprises at least one spring.

12. The blank forming apparatus of claim 11, wherein said spring is mounted on a pin connected to said bar.

13. The blank forming apparatus of claim 8, wherein said means for adjustably positioning comprises at least one cylindrical cam rotatably connected to said cylinder and extending through a slot in said bar.

14. The blank forming apparatus of claim 8, wherein said pins each comprise a shaft having a first end connected to said bar and a second end having an enlarged head.

* * * * *